US006687928B1

(12) United States Patent
Wilson

(10) Patent No.: US 6,687,928 B1
(45) Date of Patent: Feb. 10, 2004

(54) PORTABLE CHILD'S BED

(76) Inventor: Michelle Wilson, 9510 Cove Dr., Unit C-6, North Royalton, OH (US) 44133

( * ) Notice: Subject to any disclaimer, the term of this patent is extended or adjusted under 35 U.S.C. 154(b) by 0 days.

(21) Appl. No.: 10/243,312

(22) Filed: Sep. 13, 2002

(51) Int. Cl.[7] ..... F16B 7/10; A47D 7/00; A47D 9/00

(52) U.S. Cl. ..... 5/99.1; 5/98.2; 5/102; 403/59

(58) Field of Search ..... 5/98.1, 98.2, 99.1, 5/102, 101, 93.2, 655; 383/4; 224/575, 158; 190/1, 2, 24; 403/59, 109.3, 378, 391, 389

(56) References Cited

U.S. PATENT DOCUMENTS

| | | | | | |
|---|---|---|---|---|---|
| 823,321 | A | * | 6/1906 | Dejonge | 5/98.3 |
| 1,533,636 | A | * | 4/1925 | Day | 206/8 |
| 1,941,902 | A | * | 1/1934 | Lewis | 5/98.3 |
| 2,253,024 | A | * | 8/1941 | Farrand | 5/98.1 |
| 3,034,153 | A | * | 5/1962 | Sargent | 5/98.1 |
| 3,466,677 | A | * | 9/1969 | Glaser | 5/93.1 |
| 4,045,045 | A | * | 8/1977 | Boucher et al. | 280/642 |
| 4,124,909 | A | | 11/1978 | Saeedy | |
| 4,198,718 | A | | 4/1980 | Ballard | |
| 4,571,760 | A | | 2/1986 | Kassai | |
| D288,636 | S | | 3/1987 | McLaren | |
| 4,698,862 | A | * | 10/1987 | Mairs | 5/98.1 |
| 4,796,314 | A | * | 1/1989 | Garduno | 5/98.2 |
| 5,193,234 | A | * | 3/1993 | Joaquin | 5/99.1 |
| 5,265,289 | A | * | 11/1993 | Swiger et al. | 5/111 |
| 5,611,414 | A | | 3/1997 | Walker | |
| 5,813,681 | A | * | 9/1998 | Saint et al. | 280/87.051 |
| 6,199,229 | B1 | | 3/2001 | Wong | |
| 6,253,396 | B1 | | 7/2001 | Weston | |
| 6,345,400 | B2 | | 2/2002 | Elliott | |
| 6,370,715 | B1 | | 4/2002 | Morton | |

* cited by examiner

*Primary Examiner*—Heather Shackelford
*Assistant Examiner*—Lisa M. Saldano
(74) *Attorney, Agent, or Firm*—John D. Gugliotta; Olen L. York, III

(57) ABSTRACT

A portable child's bed is a bassinet hangably suspended from a pair of frame members. The bassinet includes a pair of opposing sidewalls that have a seam which allows for the sidewalls to inwardly pivot and then fold so as to allow for the compaction of the bassinet unit. The bassinet also includes a plurality of storage pockets capable of holding such infant-care related items such as diapers, powder, ointments, small blankets, towelettes, formula, feeding bottles and many other related items. The bassinet may also include a canopy for shielding the infant's head while resting or sleeping. The frame members include a telescoping strut which extendably expands or contracts within a strut housing. The telescoping strut and strut housing are in fluid communication and connected by a rotatable joint having an anterior and posterior sleeve to accommodate the pair of frames. The anterior sleeve is rotatable through 180°, thereby providing the pair of frames the ability to fully expand and position the telescoping struts in such a way so as to provide support to the bassinet. The anterior sleeve also allows for the frames to be compacted so as to reconfigure the portable child's bed into a lightweight and convenient travel bag.

18 Claims, 8 Drawing Sheets

PORTABLE CHILD'S BED

RELATED APPLICATIONS

The present invention was first described in Disclosure Document Registration No. 510,661 filed on Apr. 29, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to child beds, and specifically a portable child's bed having a pivoting and articulated frame for hanging a bassinet therefrom.

2. Description of the Related Art

There are several types of portable beds well known in the art having a foldable or retractable body which allows a user to store or easily transport the portable bed. However, these portable beds suffer from several disadvantages which limit the effectiveness and/or versatility of the device. A number of these portable bed systems are described below and are indicative of the unique advantages offered by the present invention.

In U.S. Pat. No. 6,370,715, issued in the name of Morton, a portable bed for a newborn infant is disclosed. The portable bed disclosed in U.S. Pat. No. 6,370,715 includes a flat support surface for a mattress hinged about midway to allow the bed to be folded. The portable bed also has a rigid head board. However, the portable bed has no legs to allow the apparatus to stand alone. Instead, the portable bed must be placed on a flat or relatively flat surface, such as an adult bed, couch or a table.

Similarly, U.S. Pat. No. 4,571,760, issued in the name of Kassai, discloses collapsible and foldable carry-cot for transporting an infant. The carry-cot disclosed in Kassai is of the general type of carry-cot, having an open protective shell with padded lateral walls, but provides the added feature of collapsing and folding when not in use. The collapsible carry-cot includes a link means system having four link means for supporting the lateral walls and which collapse to allowing compaction of the walls to a relatively flat configuration. However, the carry-cot does not have legs to allow the carry-cot to stand alone. Instead, the carry-cot must be placed on a flat or relatively flat surface, such as an adult bed, couch or table.

In U.S. Pat. No. 4,124,209, issued in the name of Saeedy, a collapsible frame for supporting a baby bed is disclosed. The collapsible frame disclosed in Saeedy includes two vertically extending frame members. At a lower end, two angled legs project from the vertical and horizontal frame members so that the frame will set on a surface. The frame is collapsible about a coupling mechanism, which allows the vertical frame members and legs to fold toward the horizontal frame member, thus forming a generally linear folded body. However, the angled legs disclosed by Saeedy are not telescoping and the bed is not adapted for use as a travel bag.

U.S. Pat. No. 6,345,400, issued in the name of Elliott et al., and U.S. Pat. No. 6,253,396, issued in the name of Weston, each disclose a cot which is adjustable or collapsible. Elliott et al. discloses a portable cot apparatus which is stackable upon another portable cot apparatus when not in use. The portable cot in Elliott et al. has four connectors with integrated legs which slide into receptacles for stacking and storing the portable cot. Weston discloses an adjustable cot having six legs supporting a outer frame member. The outer frame member houses an inner frame member divided into two portions. The two portions are pivotally adjustable about a center so as to provide an elevation in the head, or alternatively, the leg region. The adjustable cot disclosed in Weston is collapsible.

U.S. Pat. No. 5,611,414, issued in the name of Walker discloses a self-contained folding bed. The folding bed in Walker is contained within a suitcase-like container having a zipper for closing the container and a handle for transportation. Once unzipped, the container is opened and the three-layered bedding is unfolded for use. The three-layered bedding includes a lower sheet, a liner and a cushioning layer.

Other inventions that may be pertinent are U.S. Pat. No. Des. 288,636, issued in the name of McLaren, discloses a portable bed having a rectangular configuration with upwardly extending sidewalls, padded bedding, and storage compartments. U.S. Pat. No. 6,199,229, issued in the name of Wong, discloses a collapsible and foldable structure for use by infants as a play area. The structure disclosed in Wong has a flat surface and a shell enclosure for storage of play items. The structure twists about itself to fold and collapse into a circular configuration that is easy to transport or store. Finally, U.S. Pat. No. 4,198,718, issued in the name of Ballard, discloses a folding bed for a small animal. The folding animal bed has a generally rounded perimeter with a padded bed. When not in use, the folding animal bed is folded about a series of hinges and forming a semi-circular shape which is small enough for transporting or storing.

The present invention is distinct from the aforementioned U.S. Patents in that the present invention is directed for use as a child's bed and is adaptable for use as a travel bag. The child's bed has collapsing walls and telescoping legs to provide the compaction necessary to reduce the child's bed to a conveniently sized and shaped travel bag. The telescoping legs, as part of a frame system, allows the bed to hang in a suspended arrangement off of the ground or floor while providing rigid support. A unique rotatable joint having a spring urged locking system provides further security and support to the frame system. The exterior walls of the bed house a plurality of storage pockets, while the interior walls are sufficiently and generously padded to provide comfort to the infant while resting.

Consequently, there exists a continuous need for new product ideas and enhancements for existing products in the baby bed industry.

SUMMARY OF THE INVENTION

It is therefore an object of the present invention to provide portable child's bed reducibly compacted to form a travel bag.

It is a feature of the present invention to provide a portable child's bed having a cushioned bassinet with a top layer that is removable for cleaning.

It is a further feature of the present invention to provide a portable child's bed having a shielding canopy.

It is a further feature of the present invention to provide a portable child's bed having an attachable mesh drape for outdoor use.

It is still a further feature of the present invention to provide a portable child's bed having a locking and rotatable joint.

It is still a further feature of the present invention to provide a portable child's bed having telescoping struts for extending to support a bassinet or for contracting to allow reconfiguration of the bed to a travel bag.

It is still a further feature of the present invention to provide a portable child's bed having a plurality of storage pockets.

It is still a further feature of the present invention to provide a portable child's bed having a foldable top layer of a bottom surface.

It is still a further feature of the present invention to provide a portable child's bed having a spring urged locking means with an impingement head for lockably securing the position of the frame members.

It is still a further feature of the present invention to provide a portable child's bed having a removable strap which may be attached to the travel bag to provide ease of transportation.

Briefly described according to one embodiment of the present invention, a portable child's bed is a bassinet hangably suspended from a pair of frame members. The bassinet includes a pair of opposing sidewalls that have a seam which allows for the sidewalls to inwardly pivot and then fold so as to allow for the compaction of the bassinet unit. The bassinet also includes a plurality of storage pockets capable of holding such infant-care related items such as diapers, powder, ointments, small blankets, towelettes, formula, feeding bottles and many other related items. The bassinet may also include a canopy for shielding the infant's head while resting or sleeping. The frame members include a telescoping strut which extendably expands or contracts within a strut housing. The telescoping strut and strut housing are in fluid communication and connected by a rotatable joint having an anterior and posterior sleeve to accommodate the pair of frames. The anterior sleeve is rotatable through 180°, thereby providing the pair of frames the ability to fully expand and position the telescoping struts in such a way so as to provide support to the bassinet. The anterior sleeve also allows for the frames to be compacted so as to reconfigure the portable child's bed into a lightweight and convenient travel bag.

The use of the present invention provides users with all of the materials and tools necessary to transport, assemble and use the portable child's bed.

An advantage of the present invention is that it is specifically adapted for interior or exterior use.

A further advantage of the present invention is that it is lightweight and easy to use.

A further advantage of the present invention is that a variety of colors and/or designs may be incorporated into the exterior fabric.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 2*b* is an elevated perspective of the bassinet in FIG. 2*a* in which the force "F" has been applied and the sidewalls 16 and 20 are inwardly pivoting in the direction "C" and "D", respectively;

DESCRIPTION OF THE PREFERRED EMBODIMENTS

The best mode for carrying out the invention is presented in terms of its preferred embodiment, herein depicted within the Figures.

1. Detailed Description of the Figures

Figure 1A:
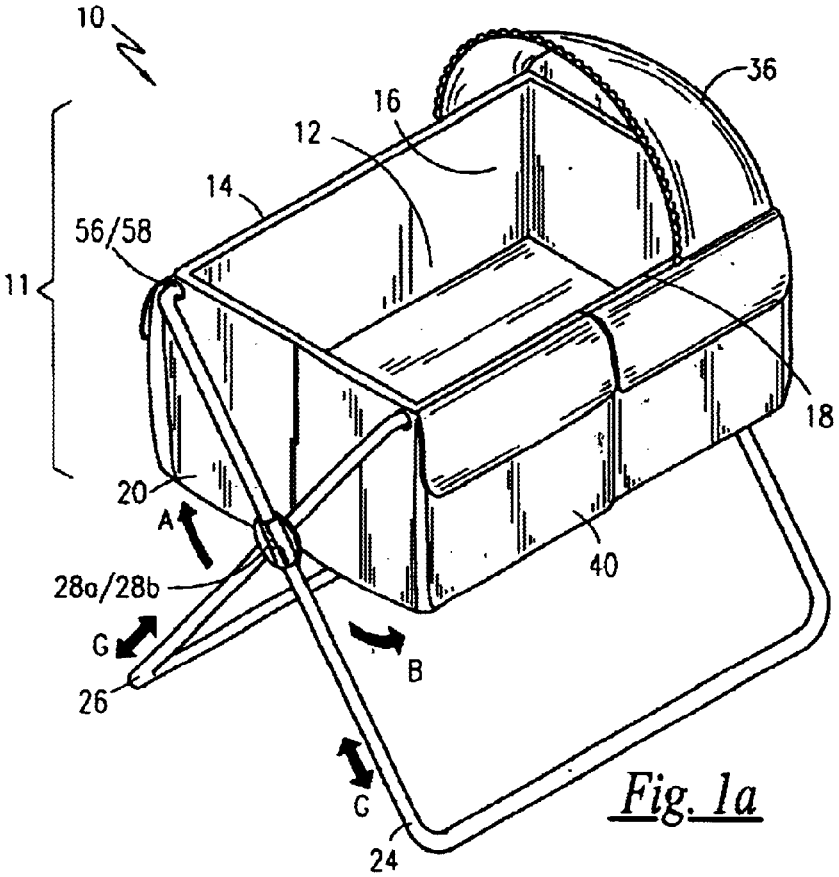
FIG. 1*a* is a perspective view of a portable child's bed with the telescopic struts completely extended and locked within the strut housings.
Figure 1B:
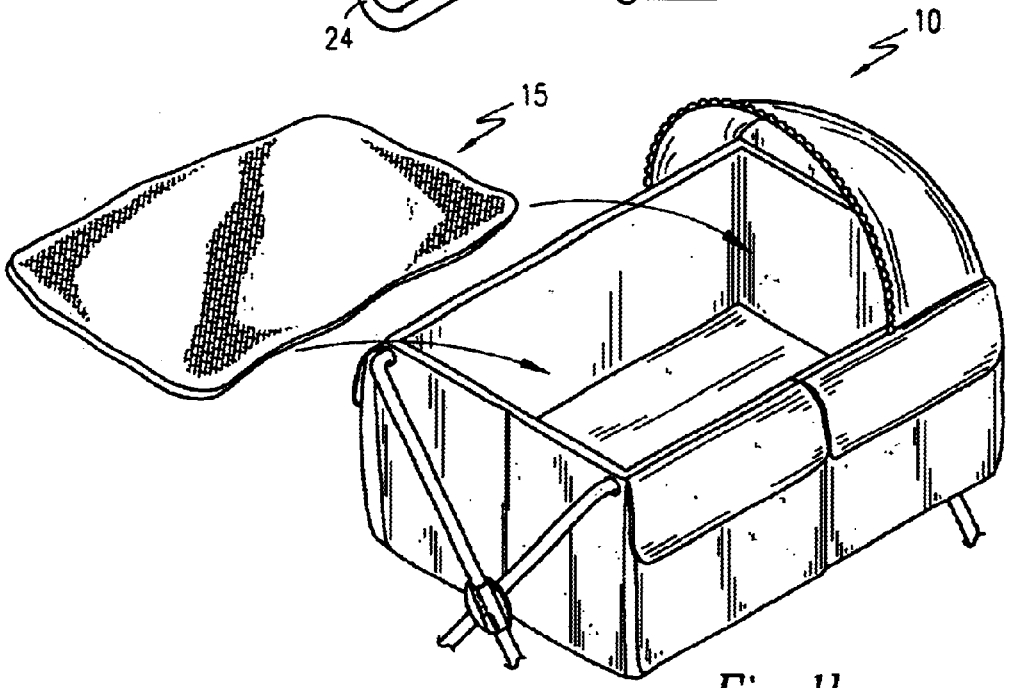
FIG. 1*b* is a perspective view of the apparatus of FIG. 1*a* and further illustrating the use of a mesh drape for covering the bassinet when used outdoors.

Referring now to FIG. 1*a* and FIG. 1*b*, a portable child's bed 10 is shown, in accordance with the preferred embodiment of the present invention, and includes a bassinet 11 having a sleeping volume 12. The sleeping volume 12 is formed by four sidewalls; a first sidewall 14, a second sidewall 16, a third sidewall 18 and a fourth sidewall 20 consecutively depending from one another, and a planar bottom surface 22 which perpendicularly depends from the four sidewalls 14, 16, 18 and 20. The portable child's bed 10 further includes a pair of frame members 24 and 26. A first frame member 24 is coupled to a second frame member 26 about a first rotatable joint 28*a* and a second rotatable joint 28*b*. The first frame member 24 and the second frame member 26 elevate and mechanically support the bassinet 11 when the frame members 24 and 26 are completely expanded. A mesh drape 15 is available for attachment to the bassinet 11 for covering the child when the portable child's bed 10 is used outdoors, thereby preventing insect bites or general annoyance.

The sleeping volume 12 forms a generally rectangular perimeter and has padding, generally noted as 30, within the interior portions of the first, second, third and fourth sidewalls 14, 16, 18 and 20, and padding 30 within the interior portion of the planar bottom surface 22. Preferably, the padding 30 for the sidewalls 14, 16, 18 and 20 and planar bottom surface 22 is manufactured from foam having a thickness of approximately two inches, although other padding material and various thicknesses are envisioned. As best seen in FIG. 3, FIG. 4, FIG. 5*a* and FIG. 5*b*, the padding 30 is covered by an intermediate liner 32, manufactured from vinyl or another suitable repellant or protective covering, to protect the foam from milk, formula, water, food, urine, feces or other bodily fluid expelled by the child. The padding 30 is further covered by an outer sheet 34, which is preferably of a soft material, such as cotton. The padding 30 for the sidewalls 14, 16, 18 and 20 may vary in thickness, but, preferably, the thickness is at least one inch. The sleeping volume 12 is partially covered by a removable canopy 36 that is affixed at the second sidewall 16 and along the first and third sidewalls 14 and 18, thus forming an arcuate covering for where the infant's head rests. The canopy 36 is affixed by an attachment means 38, wherein the attachment means 38 may include hook and loop fasteners, button snaps, clips or zippers.

Referring now to FIG. 1*a*, FIG. 1*b*, FIG. 2*a*, FIG. 2*b* and FIG. 3, the first and third sidewalls 14 and 18 are mirror images of one another, wherein the first sidewall 14 is positioned opposite to the third sidewall 18, thus the description of the first sidewall 14 will serve as a representative of the first and third sidewalls 14 and 18. The first sidewall 14 includes an interior portion 14*a* integrally coupled with and coplanar to an exterior portion 14*b* and sharing a coplanar common wall 14*c*, which serves as the rear support for the interior and exterior portions 14*a* and 14*b*. The interior portion 14*a* includes the outer sheet 34, the intermediate liner 32 and the padding 30. The exterior portion 14*b* includes a plurality of storage pockets 40. A storage pocket 40 is formed by a first lateral panel 44 and a second lateral panel 46 depending from the common wall 14*c*, and a front panel 42 opposite to the common wall 14*c* and perpendicularly depending from the first lateral panel 44 and the second lateral panel 46, with a base panel 48 perpendicularly depending from the lowest end of the front panel 42, the first and second lateral panels 44 and 46, and the common wall 14*c*. In the top of a storage pocket 40 is an opening 50 for inserting storage items, such as diapers, towels, baby powder or other baby care related products. A storage pocket 40 is enclosed by a flexible covering 52 extending over the opening 50 and affixed to the front panel 42 by an attachment means 54, such as hook and loop fasteners, button snaps or buttons. The first sidewall 14 further includes a first channel 56 formed by the top portion of the first sidewall 14 and which transverses the length of a top portion of the first sidewall 14, thus receiving the upper horizontal rail 70 of the first frame member 24 or the second frame member 26. The arrangement of the upper horizontal rail 70 within the first channel 56 allows for a minimal amount of motion to gently rock the bassinet 11 in the general direction indicated by the two directional arrow "A–B" (as shown in FIG. 1*a*).

The third sidewall 18 includes an interior portion 18*a* integrally coupled with a coplanar exterior portion 18*b* and sharing a coplanar common wall 18*c*, which serves as the rear support for the interior and exterior portions 18*a* and 18*b*. The interior portion 18*a* includes the outer sheet 34, the intermediate liner 32 and the padding 30. The exterior portion 18*b* includes a plurality of storage pockets 40. The third sidewall 18 further includes a second channel 58 formed by the top portion of the third sidewall 18 and which transverses the length of a top portion of the third sidewall 18, thus receiving the upper horizontal rail 70 of the first frame member 24 or the second frame member 26. The arrangement of the upper horizontal rail 70 within the second channel 58 allows for a minimal amount of motion to gently rock the bassinet 11 in the general direction indicated by the two directional arrow "A–B".

Referring now to FIG. 1*a*, FIG. 1*b*, FIG. 2*a*, FIG. 2*b* and FIG. 4, the second sidewall 16 and fourth sidewall 20 are mirror images of one another, wherein the second sidewall 16 is positioned opposite to the fourth sidewall 20, thus the description of the second sidewall 16 will serve as a representative of the second and fourth sidewalls 16 and 20. The second sidewall 16 includes an interior portion 16*a* integrally coupled with a coplanar exterior portion 16*b* and sharing a coplanar common wall 16*c*, which serves as the rear support for the interior and exterior portions 16*a* and 16*b*. The interior portion 16*a* includes the outer sheet 34, the intermediate liner 32 and the padding 30. The second sidewall 16 further includes a pivoting seam 16*d* which allows the second sidewall 16 to fold inwardly (indicated by directional arrow "C") toward the opposing fourth sidewall 20. When a force "F" (indicated by direction arrows "F") is applied to the first or third sidewalls 14 or 18, or is applied to both the first and third sidewalls 14 and 18, an inward folding of seam 16*d*, and the complimentary inward folding of seam 20*d* (described below) results and allows the bassinet 11 to collapse into a flattened and compacted configuration convenient for transportation.

The fourth sidewall 20 includes an interior portion 20*a* integrally coupled with a coplanar exterior portion 20*b* and sharing a coplanar common wall 20*c*, which serves as the rear support for the interior and exterior portions 20*a* and 20*b*. The interior portion 20*a* includes the outer sheet 34, the intermediate liner 32 and the padding 30. The fourth sidewall 20 further includes a pivoting seam 20*d* which allows the second sidewall 20 to fold inwardly toward the opposing second sidewall 16. When a force "F" (indicated by direction arrows "F") is applied to the first or third sidewalls 14 or 18, or is applied to both the first and third sidewalls 14 and 18, an inward folding of seam 20*d*, and the complimentary inward folding of seam 16*d* (described above) results and allows the bassinet 11 to collapse into a flattened and compacted configuration convenient for transportation.

Referring now to FIG. 2*a*, FIG. 2*b*, FIG. 5*a* and FIG. 5*b*, the planar bottom surface 22 includes a top layer 60 lying adjacent to and on top of a bottom layer 62. The top layer 60 is a sufficiently rigid structure and includes the outer sheet 34, the intermediate liner 32 and the padding 30. The top layer 60 is affixed to the first or third sidewall 14 or 18 by stitching 63*a*, an adhesive substance 63*b*, or hook and loop material 63*c*, wherein the stitching 63*a*, adhesive 63*b* or hook and loop material 63*c* extends along the length of one lateral side 64 of the top layer 60. The stitching 63*a*, adhesive 63*b* or hook and loop material 63*c* permits the top layer 60 to pivot along a lateral side 64 and in a line indicated by the directional arrow "A–B". The hook and loop material 63*c* further provides a user with the option of removing the top layer 60 from the bassinet 11 for cleaning. The bottom layer 62 is a pliable material that is affixed to the first and third sidewall 14 or 18 by stitching 63*a* or adhesive 63*b*, wherein the stitching 63*a* or adhesive 63*b* extends along the lengths of two lateral sides 66 and 68 of the bottom layer 62. The bottom layer 62 provides horizontal support to the top layer 60 and prevents the top layer 60 from falling down and through the bassinet 11 when the child is place therein. The pliability of the bottom layer 62 allows the bottom layer 62 to assume a compacted or folded configuration when the portable child's bed 10 is collapsed for storage or transportation. The bottom layer 62 compacts or folds in a generally upward direction so as to be completely enveloped by the four sidewalls 14, 16, 18 and 20 when the portable child's bed 10 is collapsed.

Figure 6:
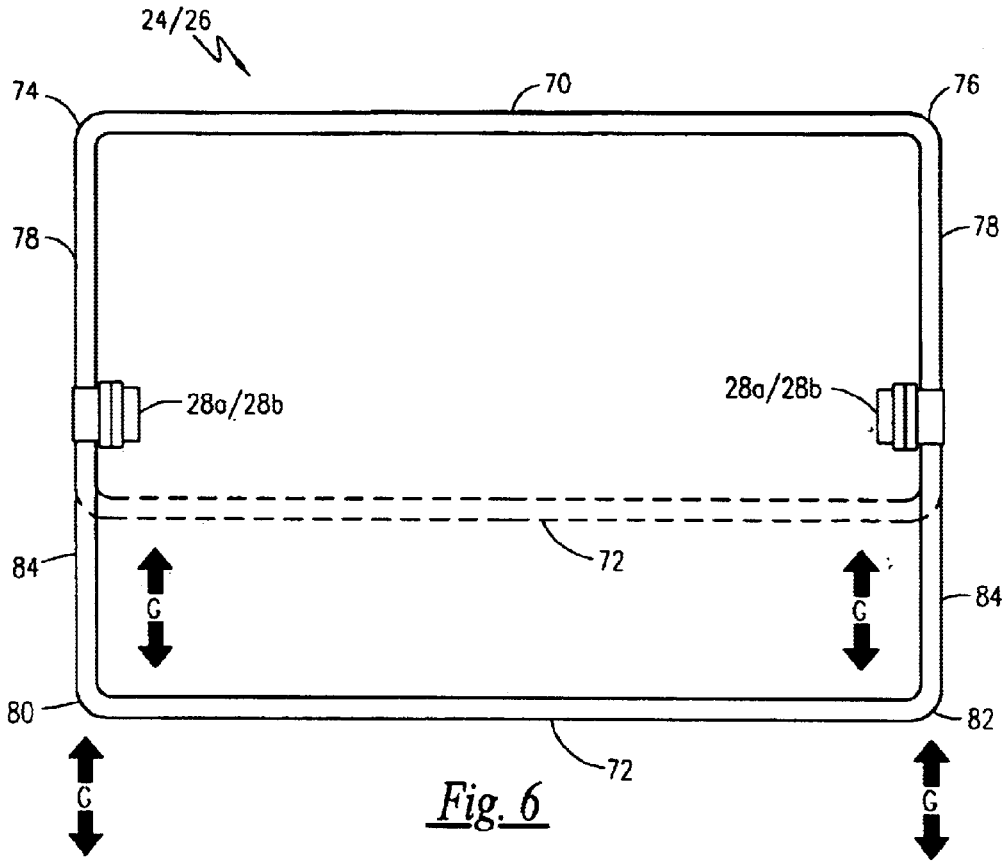
FIG. 6 is a side view of frame members 24 or 26 illustrating the telescopic nature (indicated by directional arrow "G") of the telescoping strut 84.
Figure 7:
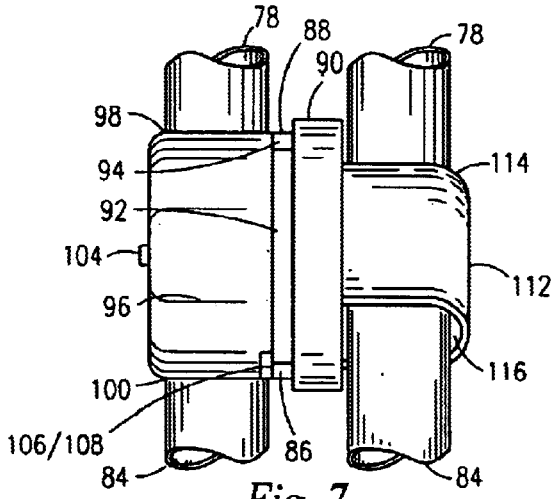
FIG. 7 is a side view of the rotatable joint 28*a* or 28*b* with a pair of strut housings 78 and a pair of telescoping struts 84 coupled therein.

Referring now to FIG. 1*a* and FIG. 6, the first frame member 24 and the second frame member 26 are mirror images of one anther, thus the description of the first frame member 24 will serve as a representative of the first and second frame members 24 and 26. The first frame member 24 forms a general rectangular perimeter and includes an upper horizontal rail 70 opposite to a lower horizontal rail 72. The upper horizontal rail 70 terminates at two opposing ends, a first end 74 and a second end 76 and is perpendicularly coupled to a pair of downwardly projected vertical strut housings 78 at each respective end 74 and 76. The lower horizontal rail 72 terminates at two opposing ends, a first end 80 and a second end 82, and is perpendicularly coupled to a pair of upwardly projected telescoping struts 84 at each respective end 80 and 82. Each strut, housing 78 respectively receives an upwardly projected telescoping strut 84.

Figure 8A:
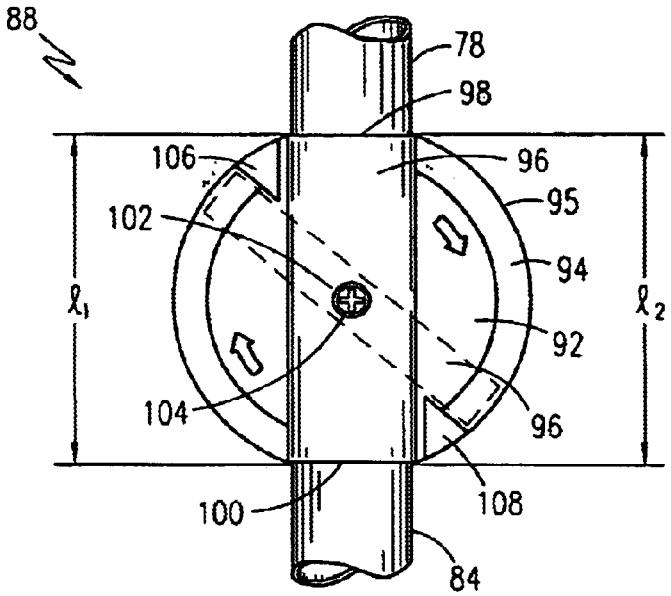
FIG. 8*a* is a plan view of an anterior surface 88 of a rotatable joint 28*a* or 28*b*, illustrating the 180° rotation of the rotatable platform 92 and corresponding anterior sleeve 96, with the resulting rotation shown in phantom lines, and the side lengths of the anterior sleeve 96 depicted as "$I_1$" and "$I_2$"

Referring now to FIG. 1*a*, FIG. 6, FIG. 7, FIG. 8*a* and FIG. 8*b*, the first rotatable joint 28*a* and the second rotatable joint 28*b* are mirror images of one another, thus the description of the first rotatable joint 28*a* will serve as a representative of the first rotatable joint 28*a* and the second rotatable joint 28*b*. Each rotatable joint 28*a* or 28*b*, and described here for illustrative purposes as the first rotatable joint 28*a*, includes a disc-shaped platform 86 having an anterior surface 88 and a posterior surface 90. As best seen in FIG. 8*a*, the anterior surface 88 includes a recessed rotatable platform 92 housed within and surrounded by a rounded shoulder 94, wherein the rounded shoulder 94 circumscribes the circumference 95 of the anterior surface 88. The rotatable platform 92 includes a horseshoe-shaped anterior sleeve 96 having a first receiving end 98 and a second receiving end 100, wherein the first receiving end 98 receives the downwardly projected strut housing 78 and the second receiving end 100 receives the upwardly projected telescoping strut 84. The anterior sleeve 96 acts as a conduit by providing fluid communication between the strut housing 78 and the telescoping strut 84. The anterior sleeve 96 further includes a first upper orifice 102 for receiving an impingement head 104 to lockably secure the telescoping strut 84 within the strut housing 78. The impingement head 104 is explained in greater detail below. The anterior surface 88 further includes a first dog 106 and a second dog 108, wherein the first dog 106 and the second dog 108 are positioned parallel to and affixed on the anterior surface 88 and along the rounded shoulder 94. The first dog 106 and the second dog 108 are placed 180° apart on the anterior surface 88, thereby providing the rotatable platform 92 with 180° of rotation. Preferably, the first dog 106 and the second dog 108 are triangular in shape so as to provide a greater surface area for mechanically interfering with the rotation of the anterior sleeve 96, and without sharp-edged projections that might impart damage to either the anterior sleeve 96 or the first dog 106 or second dog 108. As shown in FIG. 8*a*, the greatest surface area provided by the first and second dogs 106 and 108 occurs when the first lateral side "$I_1$" of the anterior sleeve 96 abuts flush against the first dog 106 and the second lateral side "$I_2$" of the anterior sleeve 96 abuts flush against the second dog 108 in either the collapsed position or in the expanded position (shown in phantom lines).

Figure 8B:
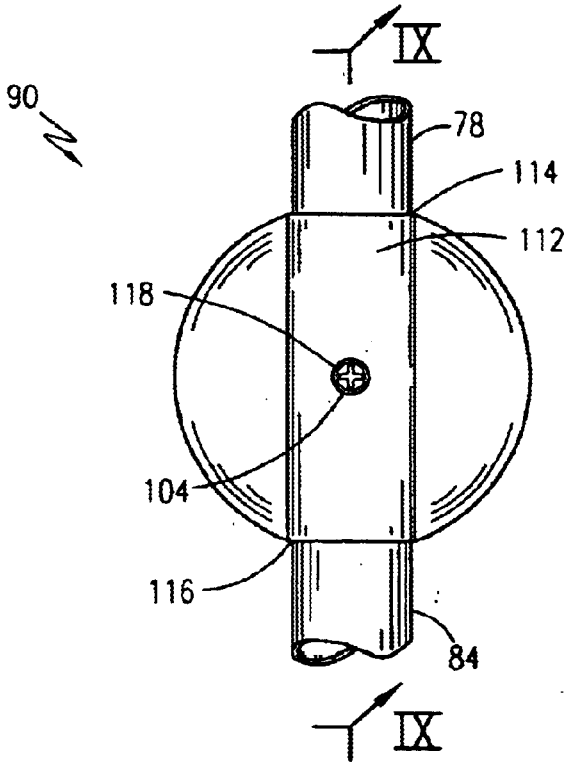
FIG. 8*b* is a plan view of a posterior surface 90 of a rotatable joint 28*a* or 28*b;*

As best seen in FIG. 8*b*, the posterior surface 90 includes a stationary platform 110 integral with the rotatable platform 92 and rounded shoulder 94 of the anterior surface 88. The stationary platform 110 includes a horseshoe-shaped posterior sleeve 112 having a third receiving end 114 and a fourth receiving end 116, wherein the third receiving end 114 receives a strut housing 78 and the fourth receiving end 116 receives the telescoping strut 84. The posterior sleeve 112 further includes a second upper orifice 118 for receiving an impingement head 104 to lockably secure the telescoping strut 84 within the strut housing 78. The impingement head 104 is explained in greater detail below. Like the anterior sleeve 96, the posterior sleeve 112 acts as a conduit providing fluid communication between the strut housing 78 and the telescoping strut 84.

Figure 9A:
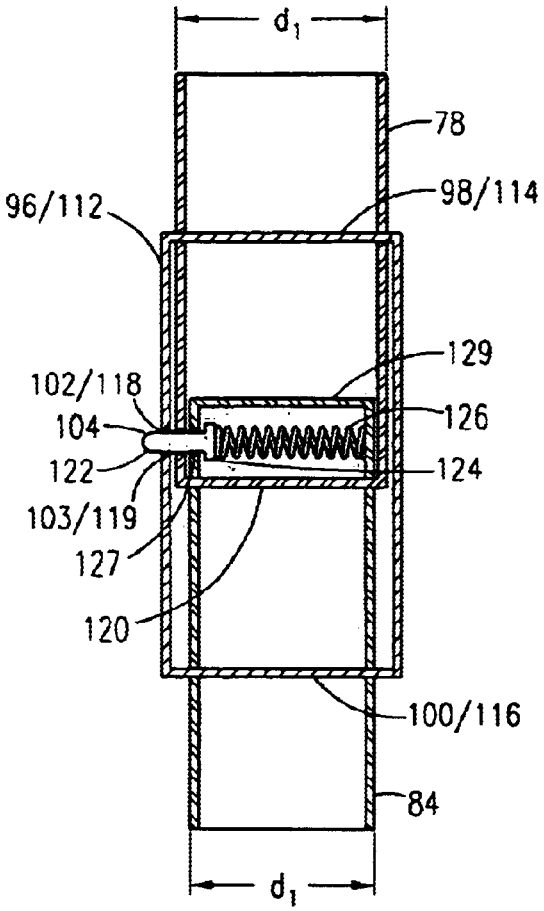
FIG. 9*a* is cross-sectional view of a rotatable joint 28*a* or 28*b*, taken through line IX—IX of FIG. 8*b*, illustrating the fluid communication of a rotatable joint 28*a* or 28*b* with a strut housing 78 and a telescoping strut 84, wherein an spring urged locking means 122, having an impingement head 104, is shown snapped into a locked and secure position.

As best seen in FIG. 1*a* and FIG. 9*a*, each strut housing 78 is a linearly elongated member having a larger cross-sectional diameter "$d_1$" than the cross-sectional diameter "$d_2$" respective telescoping strut 84 received so as to accommodate the slidable insertion and extraction of the telescoping strut 84. A lower end 120 of each strut housing 78 is integrally coupled to the first and second rotatable joint 28*a* and 28*b* at a first receiving end 98 and a third receiving end 114. Each strut housing 78 may include a first lower orifice 102 corresponding to a first upper orifice 103 in the anterior or posterior sleeve 96 or 112, or a second lower orifice 118 corresponding to a second upper orifice 119. The first lower orifice 102 and the first upper orifice 103 align (and likewise, the second lower orifice 118 aligns with the second upper orifice 119) so that an impingement head 104 may penetrate and lockably snap into and through the lower and upper orifices 102/118 and 103/119, thereby impinging the slidable movement of the telescoping strut 84 within the strut housing 78.

Figure 9B:
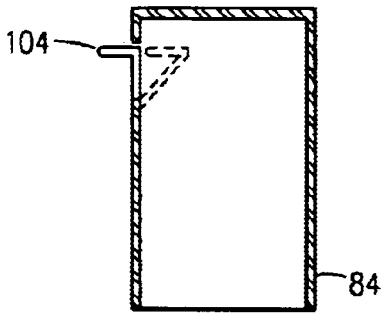
FIG. 9*b* is a cross-sectional view of an alternative embodiment of the impingement head 104 of FIG. 9*a*, wherein the impingement head 104 does not have a boss or biased spring, but instead is integral to the surface of the telescoping strut 84.

Each telescoping strut 84 is a linearly elongated member having a smaller cross-sectional diameter "$d_2$" than the cross-sectional diameter "$d_1$" of the recipient strut housing 78. An upper end 129 of each telescoping strut 84 is inserted into the first or second rotatable joint 28*a* or 28*b* at a second receiving end 100 and a fourth receiving end 116. Each telescoping strut 84 includes a spring urged locking means 122 having an impingement head 104, an impingement boss 124 at the base of the impingement head 104 and an outwardly biased spring 126. The impingement head 104 may penetrate the telescoping strut 84 through an impingement orifice 127 or may be integral to the exterior surface of the telescoping strut 84 (but without the boss 124 and the outwardly biased spring 126, as shown in FIG. 9*b*). The impingement head 104 slides along the interior surface of the strut housing 78 until the impingement head 104 engages and penetrates the aligned orifices 102/118 or 103/119. Penetration of the impingement head 104 through the aligned orifices 102/118 or 103/119 provides mechanical interference to the sliding motion of the telescoping strut 84 and locks the first and second frame members 24 and 26 so as to provide a secure and stable support to the bassinet 11.

Figure 10A:
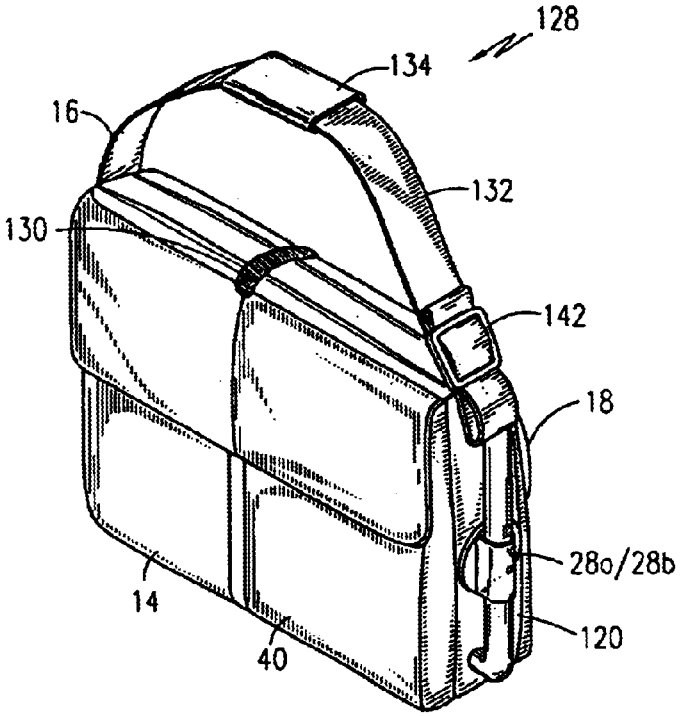
FIG. 10*a* is a perspective view of the portable child's bed 10 reconfigured through compaction into a travel bag 128, wherein the travel bag 128 shown has a strap 132 attached via a buckle 142.
Figure 10B:
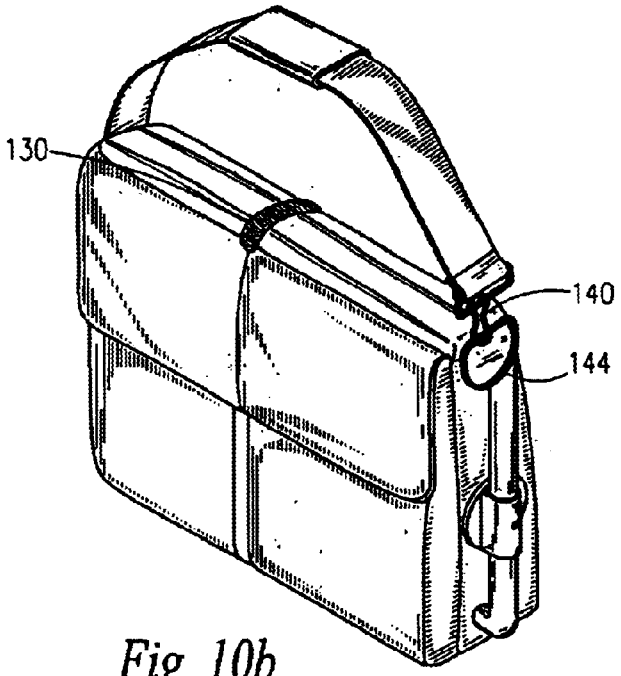
FIG. 10*b* is a perspective view of the travel bag 128 of FIG. 10*a*, wherein an alternative embodiment is shown in which the strap 132 is attached via an eye-hook 140 clipped to a hoop 144.

Referring now to FIG. 10*a* and FIG. 10*b*, when the portable child's bed 10 is collapsed, the method of which is described in further detail below, a convenient travel bag 128 formed. The travel bag 128 includes the four sidewalls 14, 16, 18 and 20 previously disclosed, wherein the second and fourth sidewalls 16 and 20 are in a folded arrangement so that the length of the second and fourth sidewalls 16 and 20 are reduced to a length that allows the first and third sidewalls 14 and 18 to abut against one another. A fastener 130 is provided so as to secure the first sidewall 14 to the third sidewall 18 and maintain the compacted form of the travel bag 128. The fastener 130 may be a hook and loop fastener, a button snap or other suitable fastening devices. A strap 132 is also provided to allow for easy carrying and transportation of the travel bag 128. The strap 132 is a linearly elongated flattened structure having a padded portion 134 so as to rest comfortably about the shoulder of a person carrying the travel bag 128. The strap 132 is affixed to the travel bag 128 at two opposing ends 136 and 138, respectively, by either an eye-hook arrangement 140 (as shown in FIG. 10*b*) or a buckle 142. The buckle 142 would require the strap 132 be woven through a hoop 144 and then through a buckle 142 to securely cinch the strap 132 about the buckle 142.

Preferably, the frame members 24 and 26 are constructed from a durable yet lightweight material, such as plastic or aluminum, so as to provide rigid support for the bassinet 11 while also providing a lightweight frame for the travel bag 128 when configured for transportation.

It is envisioned that the exterior surface of the bassinet 11 may encompass a broad range of solid colors, multi-colors, mixed designs and/or incorporate cartoon characters through licensing agreements.

2. Operation of the Preferred Embodiment

For purposes of illustration, the operation of the preferred embodiment of the portable child's bed 10 begins with the bed in the fully collapsed and compacted configuration of the travel bag 128.

Figure 2A:
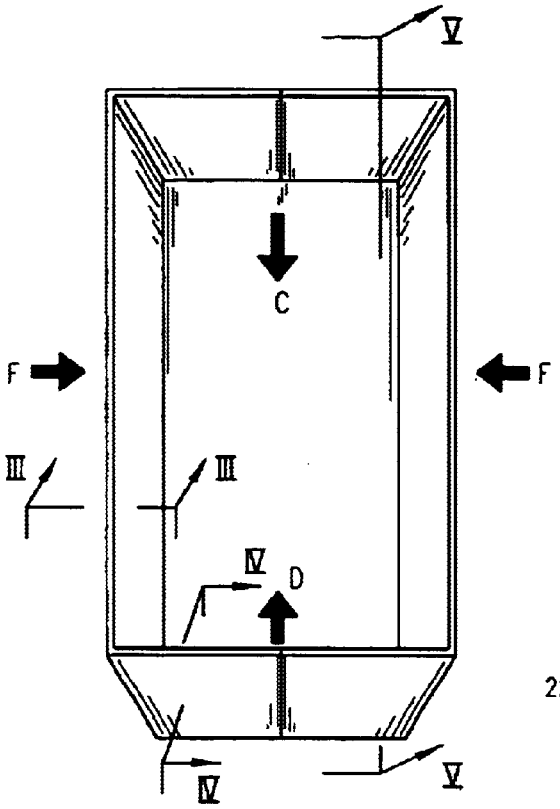
FIG. 2*a* is an elevated perspective of a bassinet illustrating the direction in which force "F" is to be applied and in which direction sidewalls 16 and 20 pivot so as to collapse the bassinet.
Figure 2A:
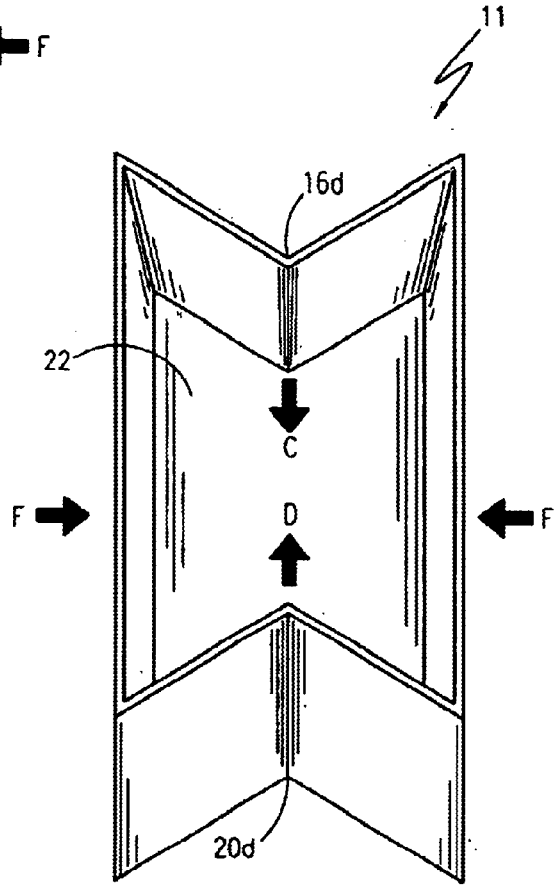
Figure 3:
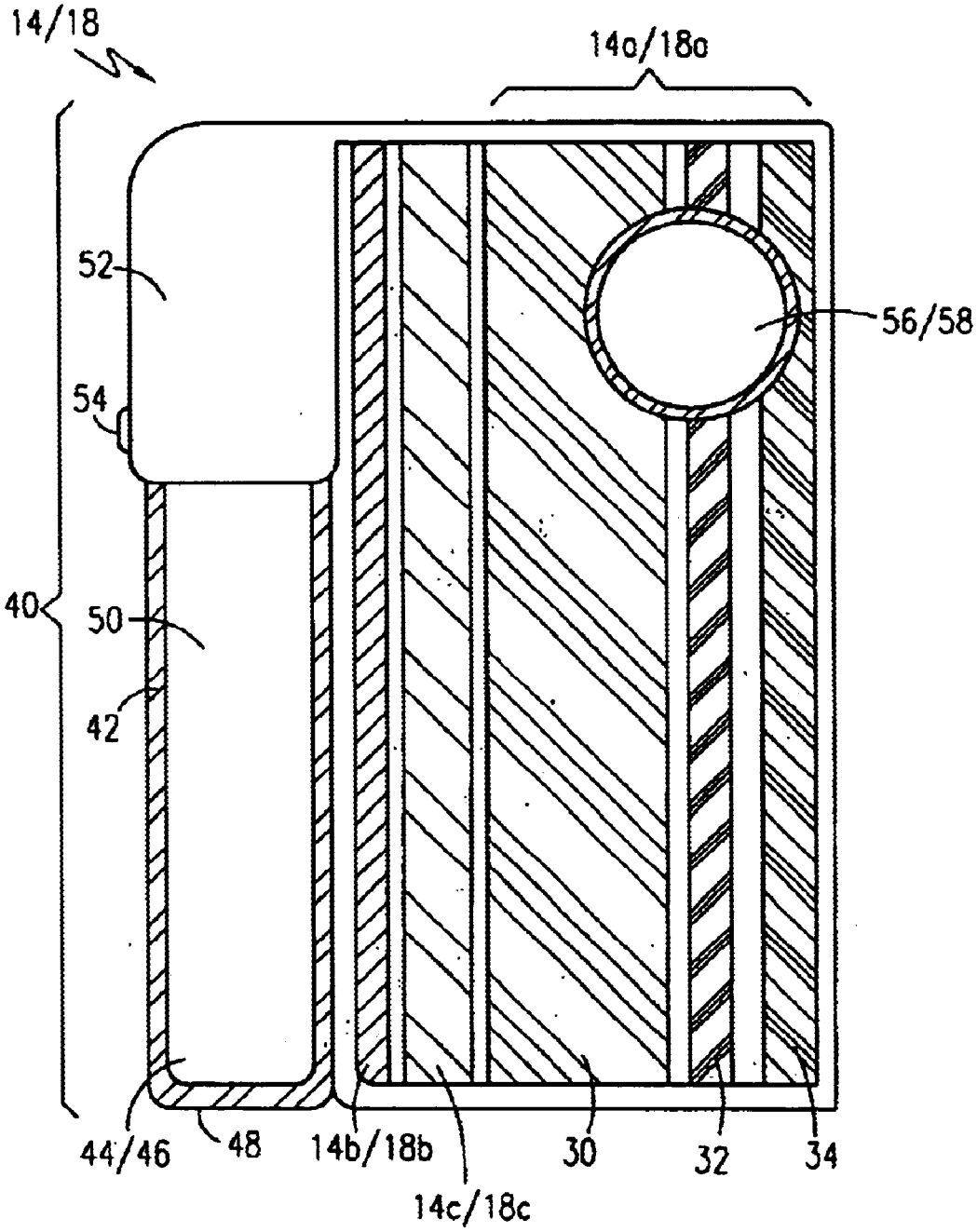
FIG. 3 is a cross-sectional view of a sidewall 14 or 18, taken through the line III—III of FIG. 2*a*, illustrating the interior contents of the sidewall 14 or 18 and the storage pocket 40.
Figure 4:
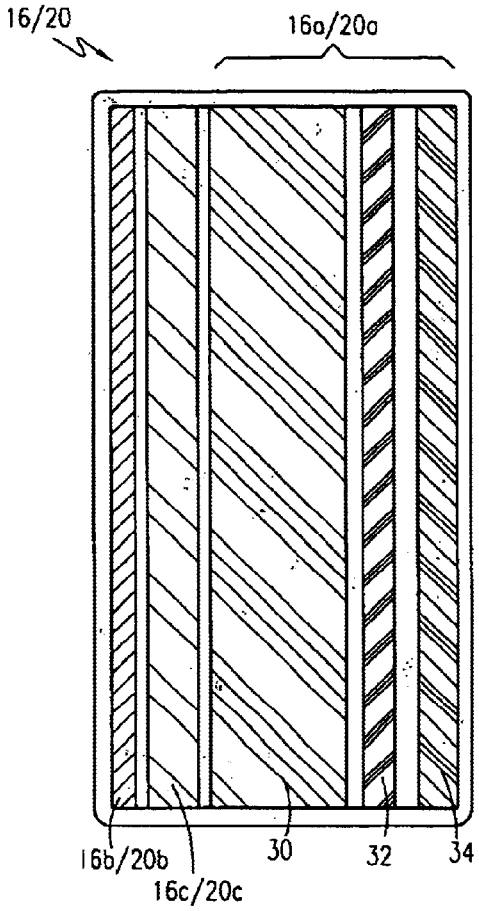
FIG. 4 is a cross-sectional view of a sidewall 16 or 20, taken through line IV—IV of FIG. 2*a*, illustrating the interior contents of the sidewall 16 or 20.

To reconfigure the travel bag 128 into the portable child's bed 10, a user will release the strap 132 by weaving the opposing ends 136 and 138 of the strap 132 through the respective buckles 142. After releasing and removing the strap 132, a user will release the fastener 130 so that the first and third sidewalls 14 and 18 are free to expand. A user will then force the first and third sidewalls 14 and 18 apart, in opposite directions (as shown in FIG. 2*a* and FIG. 2*b*), until the second and fourth sidewalls 16 and 20 unfold about their respective seems 16*d* and 20*d*, concurrent with the rotational motion of the rotatable joints 28*a* and 28*b* and the corresponding strut housings 78. A bassinet 11 having a general rectangular perimeter is formed.

A user will then slidably extend a telescoping strut 84 (as shown by the directional arrow "G" in FIG. 1*a* and FIG. 6) from within a strut housing 78 from either the first or second frame member 24 or 26 until the impingement head 104 engages and penetrates the aligned orifices 102/118 or 103/119. The impingement head 104 will snap into and through the aligned orifices 102/118 or 103/119, thereby mechanically interfering with the slidable motion of the telescoping strut 84. A user will then slidably extend a telescoping strut 84 from with a strut housing 78 from the remaining frame member 24 or 26 until the impingement head 104 snaps into place.

Figure 5A:
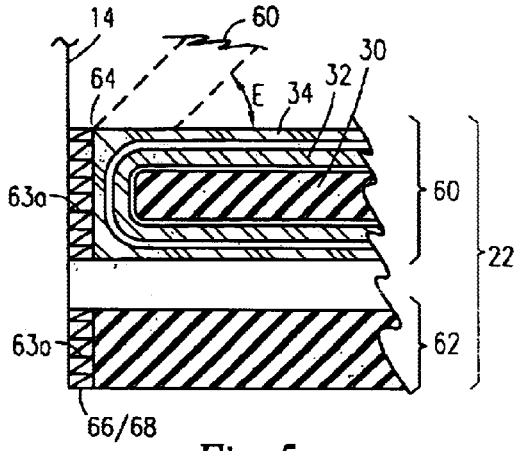
FIG. 5*a* is a cross-sectional view of a bottom planar surface 22, taken through line V—V of FIG. 2*a*, illustrating the interior contents of the bottom planar surface 22, including the top layer 60 and the bottom layer 62 attached to a sidewall by stitching 63*a*, wherein the top layer 60 is shown pivoting upward along the directional arrow "E" with phantom lines.
Figure 5B:
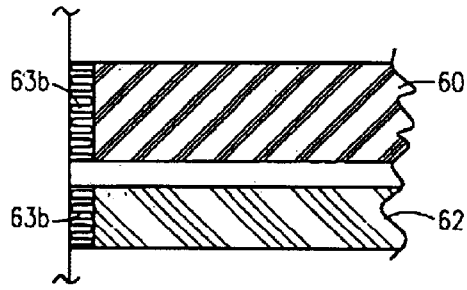
FIG. 5*b* is a cross-sectional view of a bottom planar surface 22, taken through line V—V of FIG. 2*a*, illustrating the top layer 60 and the bottom layer 62 attached to a sidewall by adhesive 63*b;*

A user will then pivotally lower the top layer 60 on top of and adjacent to the bottom layer 62, as indicated by the directional arrow "E" in FIG. 5*a*. If necessary, or desired, a user will attach the canopy 36 to the second sidewall 16 by attachment means 38 so as to provide a shield or cover for an infant's head. The canopy 36 will also attach to the first and third sidewalls 14 and 18. The fully expanded portable child's bed 10 may then be positioned wherever desired. A user will then place the infant into the sleeping volume 12 of the bassinet 11 so that the infant may rest or sleep in a protected, yet comfortable, arrangement.

To collapse the portable child's bed 10 and reconfigure the travel bag 128, a user will remove the infant from the bassinet 11. If necessary, a user will then detach the canopy 36 from the first, second and third sidewalls 14, 16 and 18. A user will then pivotally fold the top layer 60 away from the bottom layer 62 so that the top layer 60 rests against either the first or third wall 14 or 18. A user will then press the tip of the impingement head 104 into and out of the aligned orifices 102/118 or 103/119 on either the first or second frame member 24 or 26. A user will then press the tip of another impingement head 104 into and out of the remaining aligned orifices 102/118 or 103/119 on the remaining first or second frame member 24 or 26. A user will then slidably contract the telescoping strut 84 into the strut housing 78 thereby shortening the first or second frame member 24 or 26, and then repeating the slidable contraction for the telescoping strut 84 of the remaining frame member 24 or 26. A user will then apply a force "F" to the first and third sidewalls 14 and 18 so the first and third sidewalls 14 and 18 are forced together in an adjacent position to one another. Concurrently, the second and fourth sidewalls 16 and 20 will fold inwardly along the respective seams 16*d* and 20*d* so that the sidewalls 16 and 20 collapse toward one another and thereby allowing the bassinet 11 to assume a compacted configuration. A user will then secure the fastener 130 from the first sidewall 14 to the third sidewall 18, or vice versa, so as to maintain the compacted configuration. Finally, user will secure the strap 132 to the eye hooks 140 (or hoops 144) at the strap's 132 opposing ends 136 and 138, thereby transforming the portable child's bed 10 to a travel bag 128. If necessary, or desired, a user may then fill the storage pockets 40 with items for transportation or storage. A user will then slip the strap 132 over a shoulder, placing the padded portion 134 at the pressure point of the strap 132 against the user's shoulder. The travel bag 132 is now ready for transportation.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A portable child's bed comprising:

a first sidewall, said first sidewall having a plurality of storage pockets;

a second sidewall depending from said first sidewall, said second sidewall foldable alone a first vertical seam;

a third sidewall, said third sidewall depending from said second sidewall and opposite to said first sidewall, said third sidewall having a plurality of storage pockets;

a fourth sidewall depending from said third sidewall and depending to said first sidewall, said fourth sidewall opposite to said second sidewall, said fourth sidewall foldable along a second vertical seam;

a planar bottom surface perpendicularly depending from said first, second, third and fourth sidewalls, respectively, thereby forming a sleeping volume;

said planar bottom surface having a foldable top layer;

a removable canopy affixed at said second sidewall, and affixed alone a portion of said first and third sidewalls, thereby forming an arcuate head covering for an infant;

a first frame member and a second frame member, said second frame member coupled to said first frame member about a pair of rotatable joints oppositely disposed, wherein said first frame member and said second frame member comprise an upper horizontal rail, said upper horizontal rail terminating at a first end and a second end opposite to said first end, each of said upper first end and said upper second end coupled to a downwardly projected strut housing; and a lower horizontal rail opposite to said upper horizontal rail, said lower horizontal rail terminating at a first end and a second end opposite to said first end, each of said lower first end and said lower second end coupled to an upwardly projected telescoping strut;

a said first rotatable joint providing fluid communication between said strut housing and said telescoping strut at said upper and lower first ends; and a said second rotatable joint providing fluid communication between said strut housing and said telescoping strut at said upper and lower second ends;

wherein said first rotatable joint and said second rotatable joint comprise a disc-shaped platform, said disc-shaped platform comprising an anterior surface and a posterior surface, said anterior surface comprising a rounded shoulder, said rounded shoulder circumscribing a circumference of said anterior surface; a rotatable platform said rotatable platform housed within a recess of said rounded shoulder; an anterior sleeve affixed to said rotatable platform, said anterior sleeve providing fluid communication between said strut housing and said telescoping strut; a first dog affixed to said anterior surface; and a second dog affixed to said anterior surface, said second dog positioned 180° apart from said first dog; said first dog and said second dog providing 180° of rotation for said rotatable platform.

2. The portable child's bed of claim 1, wherein said anterior sleeve further comprises a first receiving end and a second receiving end opposite to said first receiving end, said first receiving end receives said strut housing, said second receiving end receives said telescoping strut.

3. The portable child's bed of claim 2, wherein said anterior sleeve further comprises a first upper orifice for receiving a spring urged locking means for securing said telescoping strut to said strut housing, said spring urged locking means comprising an impingement head, an impingement boss affixed to said impingement head, and a outwardly biased spring affixed to said impingement boss.

4. The portable child's bed of claim 1, wherein said posterior surface comprises:

a stationary platform integral with a rotatable platform of said anterior surface; and a posterior sleeve affixed to said stationary platform.

5. The portable child's bed of claim 4, wherein said posterior sleeve comprises a third receiving end and a fourth receiving end opposite to said third receiving end, said third receiving end receives said strut housing, said fourth receiving end receives said telescoping strut.

6. The portable child's bed of claim 5, wherein said posterior sleeve further comprises a second upper orifice for receiving a spring urged locking means for securing said telescoping strut to said strut housing, said spring urged locking means comprising an impingement head, an impingement boss affixed to said impingement head, and a outwardly biased spring affixed to said impingement boss.

7. The portable child's bed of claim 6, wherein said strut housing is a linearly elongated member having a larger cross-sectional diameter than said telescoping strut, thereby accommodating slidable insertion and extraction of said telescoping strut through said strut housing.

8. The portable child's bed of claim 7, wherein said strut housing is coupled to said first receiving end or said third receiving end of said first or second rotatable joint.

9. The portable child's bed of claim 8, wherein said strut housing further comprises a first lower orifice or a second lower orifice, respectively, said first lower orifice aligns with said first upper orifice, said second lower orifice aligns with second upper orifice, thereby allowing said spring urged locking means to penetrate said upper and said lower orifices and lockably impinge said telescoping strut within said strut housing.

10. The portable child's bed of claim 7, wherein said telescoping strut is coupled to said second receiving end or said fourth receiving end of said first or said second rotatable joint, respectively, thereby providing fluid communication with between said telescoping strut and said strut housing.

11. The portable child's bed of claim 1, wherein said first sidewall, said second sidewall, said third sidewall and said fourth sidewall comprise an interior portion integrally coupled with and coplanar to an exterior portion, said interior portion and said exterior portion sharing a supportive common wall.

12. The portable child's bed of claim 11, wherein said interior portion and said exterior portion includes an outer sheet, an intermediate liner and padding.

13. The portable child's bed of claim 11, wherein said first sidewall comprises a first channel formed in a top portion of said first sidewall, said first channel transverses a length of said top portion.

14. The portable child's bed of claim 1, wherein said third sidewall comprises a second channel formed in a top portion of said third sidewall, said second channel transverses a length of said top portion.

15. The portable child's bed of claim 1, wherein said second sidewall and said fourth sidewall further comprise a pivoting seam for allowing said second and said fourth sidewalls to fold inwardly for compaction of said child's bed.

16. The portable child's bed of claim 1, wherein said planar bottom surface comprises a top layer lying adjacent to and on top of a bottom layer, said top layer comprising an outer sheet, an intermediate liner and padding.

17. The portable child's bed of claim 16, wherein said top layer is affixed to said first sidewall or said third sidewall along one lateral side of said top layer, thereby allowing said top layer to fold and facilitate compaction or expansion of said portable child's bed.

18. The portable child's bed of claim 16, wherein said bottom layer is a pliable material affixed to said first sidewall and said third sidewall along two lateral sides of said bottom layer, thereby providing a horizontal support structure for said top layer when folded down and adjacent to said bottom layer.

* * * * *